US005690189A

United States Patent [19]

Karner

[11] Patent Number: 5,690,189

[45] Date of Patent: Nov. 25, 1997

[54] APPARATUS AND METHOD FOR LOCKING AND UNLOCKING THE DOOR OF AN ELEVATOR CAR

[75] Inventor: Franz Josef Karner, St. Anton, Austria

[73] Assignee: Kone Oy, Helsinki, Finland

[21] Appl. No.: 550,656

[22] Filed: Oct. 31, 1995

[30] Foreign Application Priority Data

Oct. 31, 1994 [FI] Finland ..... 945128

[51] Int. Cl.[6] ..... B66B 13/06

[52] U.S. Cl. ..... 187/335; 49/116

[58] Field of Search ..... 187/335, 313, 187/314, 331; 49/116, 120

[56] References Cited

U.S. PATENT DOCUMENTS 4,423,799 1/1984 Glaser et al. ..... 187/335

FOREIGN PATENT DOCUMENTS 0164581 12/1985 European Pat. Off. .
0332841 9/1989 European Pat. Off. .
0426057 5/1991 European Pat. Off. .
2206331 1/1989 United Kingdom .
2207122 1/1989 United Kingdom .

*Primary Examiner*—Kenneth Noland
*Attorney, Agent, or Firm*—Birch, Stewart, Kolasch & Birch, LLP

[57] ABSTRACT

An apparatus for locking the door of an elevator car includes a lock (12) that locks the car door, a guide surface (9) in the elevator shaft at each landing and a linkage (6) operating the lock (12). The linkage includes an operating lever (17) which, when at a landing, presses against the guide surface (9) via a roller. The lever is pivotally attached to the linkage (6) by a movable pivot (20). When the door is reaching the closed position, a coupling element (2) transmits motion of the door to the linkage (6) to operate the lock (12) using the driving power of the door actuating mechanism.

20 Claims, 2 Drawing Sheets

APPARATUS AND METHOD FOR LOCKING AND UNLOCKING THE DOOR OF AN ELEVATOR CAR

BACKGROUND OF THE INVENTION

1. Field of the Invention

The present invention relates to an apparatus for locking the car door of an elevator, and to a procedure for locking and unlocking the car door of an elevator.

2. Description of the Background Art

Automatic elevator doors are opened and closed by a door drive mounted in conjunction with the elevator car. In a conventional arrangement, the door drive moves the door of the elevator car. The motion of the car door is transmitted to the landing door by means of a door coupler provided on the car door. When the elevator is moving, the door of its car must always remain locked so that the door cannot be opened. The door of an elevator car must also remain locked when the elevator has stopped between floors e.g. due to a power failure, so that a passenger cannot open the door by more than a few centimetres. The system for locking the elevator doors is required to be reliable and durable. The door locking system of the elevator should not produce disturbing noise.

To lock the elevator door in a reliable manner suitable for elevator applications, various systems have been devised that are either expensive or too complex. For instance, a locking system operated by a separate electro-mechanical actuator requires a separate subsystem or a parallel system for controlling the door operation, for locking and unlocking the door. Moreover, a locking system operated by a separate electro-mechanical actuator always involves an additional expense in the system, depending on the price of the actuator. Often the locking system also takes up too much space and the door of the elevator car or the door suspension has to be more or less designed on terms of the placement of the locking equipment.

SUMMARY OF THE INVENTION

To meet the need to achieve a simple mechanically operated system for locking the door of an elevator car that is applicable in modern elevator environment and technology and is advantageous in respect of manufacturing costs and space utilization, easy to install and quiet in operation, a new system for locking the door of an elevator car is presented as an invention.

The advantages achievable by the invention include the following:

- The locking apparatus is inexpensive to manufacture.
- The locking apparatus has a construction that does not require a large space, allowing the apparatus to be placed even in thin structures without difficulty.
- The locking apparatus is easy to install in conjunction with the door and, being mechanically controlled, requires no separate electric actuating equipment.
- The locking apparatus for an elevator door is applicable for use with different locks.
- The door remains locked outside floor areas, possible disturbances affecting the electrical system of the elevator have no effect on the locking.
- In the event of a power failure, if the elevator has stopped between landings, the door can be opened after the elevator has been driven manually to a landing.
- The apparatus generates no extra noise during elevator travel or when the car door is being locked or released.

- The locking and unlocking of the car door of the elevator is temporally and physically linked with the opening and closing of the door.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The locking apparatus for the door of an elevator car is designed to be operated by a driving power obtained from the door motor. In the transmission of the driving power, the door actuating mechanism is utilized by an arrangement whereby the door movement is coupled to the locking apparatus during part of the door movement for the transmission of motion and power.

Figure 1:
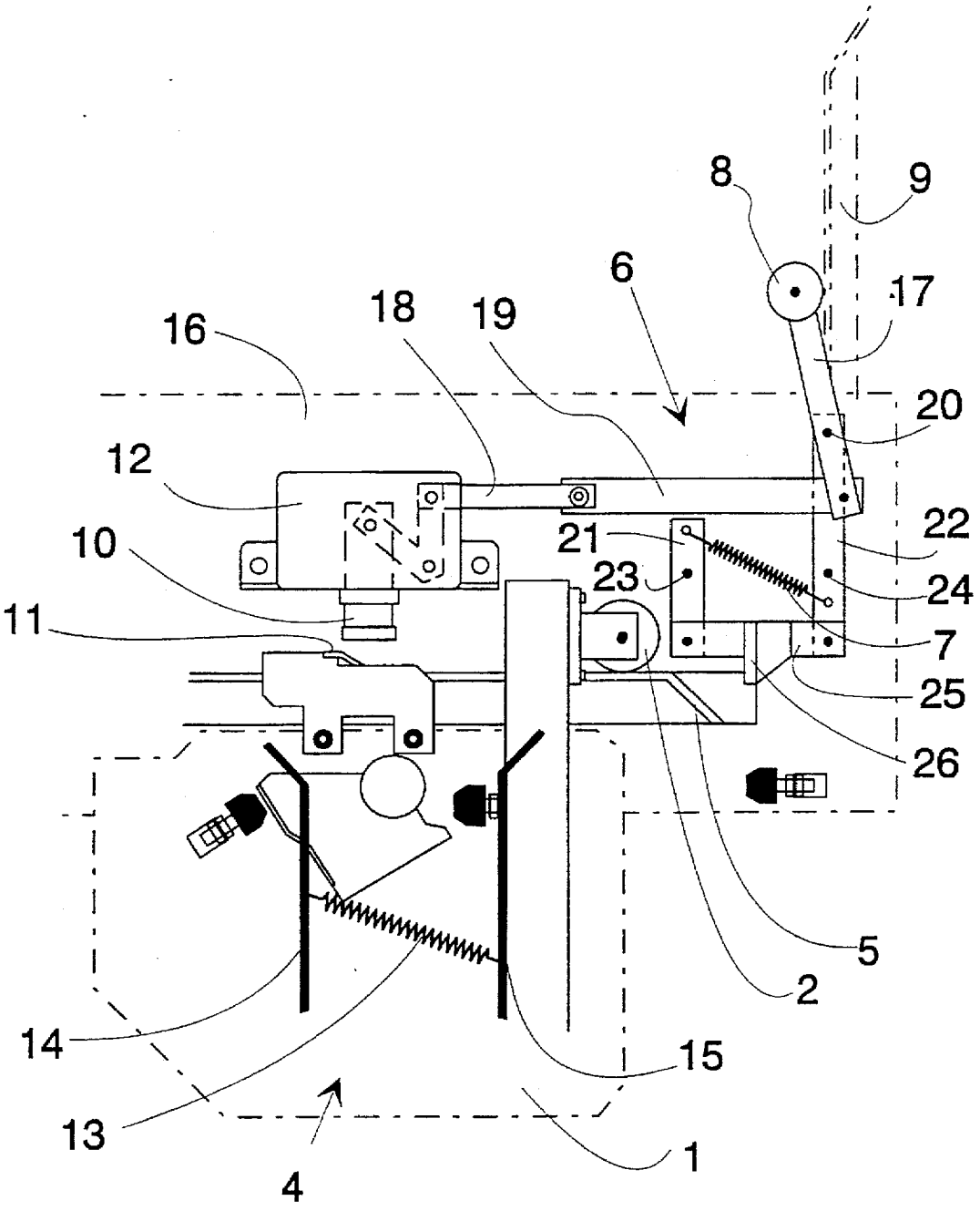
FIG. 1 presents the locking apparatus of the invention when the car is at a landing with the lock released.

FIG. 1 presents the locking apparatus of the invention and the associated equipment. The suspension plate 1 of the car door is provided with a door coupler 4 (shown only in part in the figures). A door coupler spring 13 connects the sheet metal coupling vanes 14 and 15, between which the landing door rollers (not shown in the figures) enter when the door coupler engages the landing door. The coupling vanes 14 and 15 move substantially in a horizontal direction and due to this movement the gap between the door coupling vanes 14 and 15 is opened and closed within preset limits. Vane 15 moves only through a short distance in horizontal and vertical directions with respect to the suspension plate 1. Attached to the upper part of vane 15 is a coupling roller 2. The movement of the vane 15 is controlled by the coupling roller 2, which follows a ramp 5, so that when the roller reaches the downwards sloping part of the ramp, the vane 15 will sink following the shape of the ramp 5. The ramp 5 is immovably fixed to the overhead supporting beam 16. The overhead supporting beam 16 also contains a lock 12, and the linkage 6 operating the lock is mounted with pivots on the overhead supporting beam. The pin 10 acting as the latch of the lock is in its high position, permitting the door to be opened. In the situation depicted by FIG. 1, the door is slightly open, which is evident from the fact that the thrust plate 11 of the lock, attached to the door suspension plate 1, has been shifted to the left of the lock. The linkage 6 is provided with a roller 8 designed to follow guide surfaces 9 mounted in the shaft in each landing zone, said guide surfaces having a length corresponding to the landing zone in the direction of elevator movement. When the roller 8 is on a guide surface 9, the elevator is in a landing zone and opening of the doors is enabled, whereas in other situations opening of the car door, at least from inside the car, is disabled. The linkage 6 is provided with a return element consisting of a return spring 7. In addition to the roller 8 and the return spring 7 already mentioned, the linkage comprises the following parts: an operating lever 17, the roller 8 being mounted with a bearing on the first end of the lever, a transmission bar 19 transmitting the motion of the operating lever 17 to the mechanism 18 actuating the lock pin 10 in the lock 12 and levers 21 and 22, which are turnably mounted on the overhead supporting beam 16 by pivots 23 and 24. The movement of the lock pin 10 is preferably spring-loaded. Levers 21 and 22 are connected by their ends by an intermediate link 25 so that the levers 21 and 22 remain mutually aligned in the same direction while turning about the pivots 23 and 24. When lever 22 turns about its pivot 24, this produces a horizontal movement of the pivot 20 at the first end of the operating lever 17 that connects the operating lever 17 to the linkage 6. The intermediate link 25 is provided with a lug 26 for the coupling roller 2. The figures do not show the door actuating mechanism. The opening and closing movements produced by the door actuating mechanism have a significance with respect to the invention as these movements are utilized in the locking apparatus. The movement can be transmitted either directly to the door, to the door suspension plate 1 or even to the door coupler vane 15 carrying the coupling roller 2.

Figure 2:
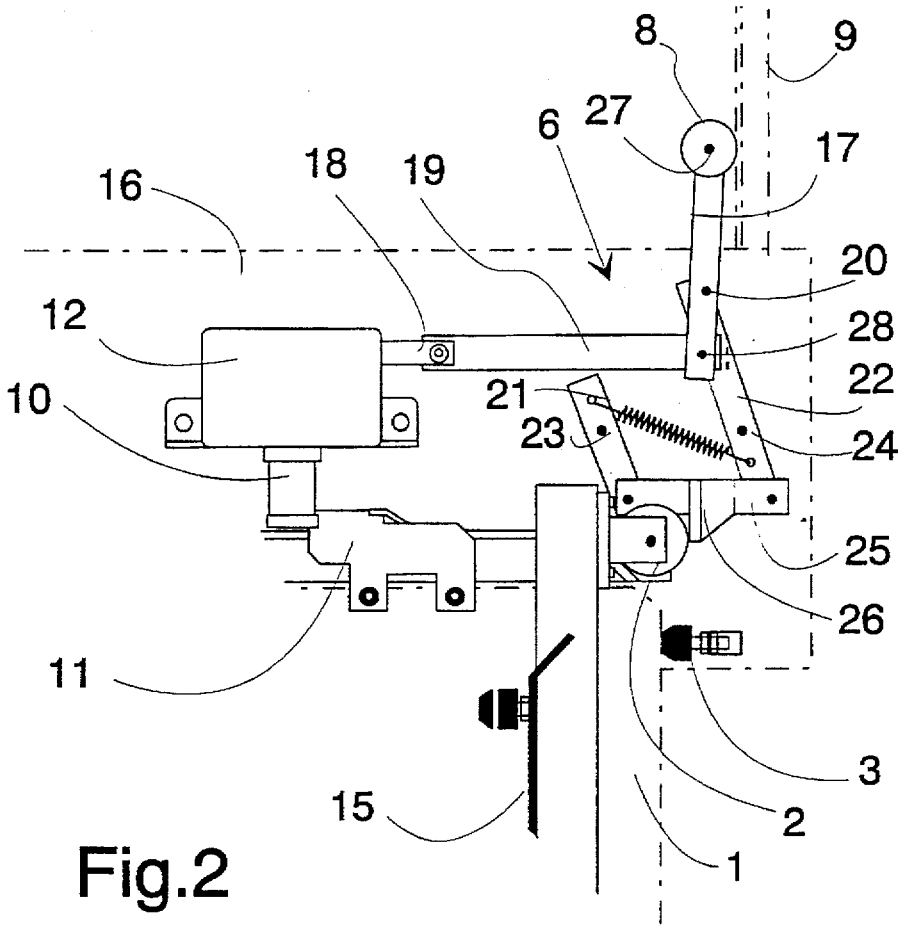
FIG. 2 presents the locking apparatus at a landing with the lock closed.

In FIG. 2, the locking apparatus is presented in a situation where the elevator is in a landing zone and the lock 12 locks the door. To lock the door, the pin 10 is thrust out from the lock to prevent the thrust plate 11 of the lock and thus also the suspension plate 1 from moving to the left. The action producing the locking is as follows. The roller 8 is on the guide surface 9. The roller shaft is the fulcrum 27 about which the operating lever 17 turns. As the door drive mechanism drives the door towards the closed position (to the right), the door coupler vane 15 moves right along with the door. The movement of the vane 15 is guided by the ramp 5 so that, as the coupling roller 2 moves from the level portion of the ramp to the portion sloping down to the right, the roller 2 forces the lug 26 connected to the linkage 6 to move before it. In this way, the coupling roller 2 couples the driving power needed for the closing of the lock 12 from the door to the linkage 6 and produces in the linkage a movement that results in the closing of the lock. As the lug 26 moves right, levers 21 and 22 are turned about their pivots 23 and 4, causing the joint 20 located between the ends of the operating lever to move left, with the result that the operating lever 17 turns about its fulcrum 27, simultaneously forcing the transmission bar 19 towards the lock (to the left in the figure). This movement of the transmission bar causes the lock pin 10 to protrude from the lock to stop the motion of the thrust plate 11 of the lock and thus to prevent the suspension plate 1 from moving left, with the result that the door cannot be opened. The premature disengagement of the roller 8 from the guide surface 9 can be prevented e.g. with a spring which is pressing roller 8 agaist surface 9. After the lock pin 10 has been pushed out to its extreme position, the mechanism 18 actuating the lock pin 10 stops the motion of the transmission bar 19 and the joint 28 at the other end of the operating lever 17 becomes the fulcrum about which the operating lever 17 turns as lever 22 pushes joint 20 to the left while the coupling roller is pressed against the lug 26. In this way, the final portion of the door closing movement disengages the roller 8 from the guide surface 9, producing a sufficient clearance between the roller and the guide surface. Another possible way to stop the motion of the transmission bar 19 is e.g. by using a pin fixed to the overhead supporting beam 16 and going through an elongated slot made in the transmission bar.

The closing movement of the door, i.e. the movement of the suspension plate 1 to the right, is limited by an end stopper 3. In addition to setting a definite end position for the door movement, the end stopper 3 together with the shape of the ramp 5 and the play of the door coupler vane 15 also sets the extreme position to which the linkage 6 can be turned by the door movement and in which the linkage is to be held when the door is in the locked condition. On the other hand, the return spring 7 tries to turn the linkage 6 to its other extreme position.

Figure 3:
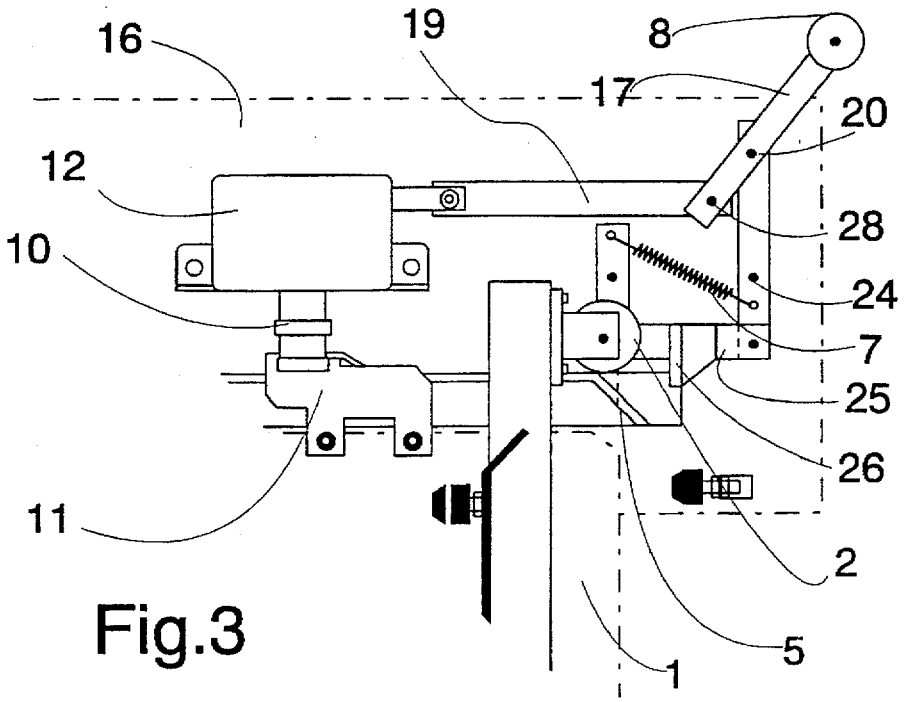
FIG. 3 presents the locking apparatus in a situation where the elevator is outside the landing zone and a passenger is trying to open the car door.

FIG. 3 shows the locking apparatus in a situation where the elevator has moved away from the landing zone, i.e. there is no guide surface in the shaft to provide a stop face for the roller 8. If an attempt is made to open the car door when the car has stopped outside the landing zone e.g. due to a power failure, then the door suspension plate 1 and therefore the thrust plate 11 of the lock 12 will move left until the thrust plate meets the lock pin 10. The allowed opening width is set by the positions of the lock 12 and its thrust plate 11 relative to each other; in practice, the maximum opening width of a locked door is set by appropriately positioning the thrust plate of the lock. Another advantageous implementation of the thrust plate of the lock is one in which the thrust plate is provided with a hole into which the pin 10 is thrust. The hole being elongated in the direction of movement of the door, the allowed maximum opening width of the door is determined by the length of the hole. Trying to open the door causes the linkage 6 to be deflected from the position in which it is intended to remain when the door is locked, and after the opening attempt the linkage 6 is returned to this intended position by virtue of the ramp 5. After the coupling roller 2 has moved up from the sloping part of the ramp 5, the coupling roller 2 no longer presses the lug 26 to the right and the return spring 7 turns levers 21 and 22 back to their rest position, causing pivot 20 to move. As there is no guide surface to provide a stop face for the roller 8, the roller shaft will not be the fulcrum about which the operating lever 17 turns. Instead, the operating lever 17 now turns about the joint 28 between the transmission bar 19 and the operating lever 17, and the motion of the operating lever does not effect a withdrawal of the transmission bar 19 from the direction of the lock 12, so no releasing effect is transmitted to the lock. Now, when the car is brought in this condition to a landing zone again, i.e. when the roller 8 meets a guide surface as illustrated by FIG. 1, then the roller 8 rising onto the guide surface 9 causes the operating lever 17 to turn about pivot 20 and the operating lever draws the transmission bar 19 so that the lock is released.

The locking and releasing cycle taking place when the elevator is in a landing zone can be briefly described as follows.

The car door is locked at the end of the door closing movement by operating the door motor. To close the door, the suspension plate 1 and door panel is driven to the end stopper 3. As the end stopper 3 is reached and after the door coupler 4 has been opened, the coupling roller 2 moves along the ramp 5. Via the lug 26, the coupling roller 2 forces the linkage 6 to turn against the spring force of the return spring 7. As a result of the movement of the linkage 6, the pin 10 of the lock 12 is thrust downwards to block the movement of the thrust plate 11 of the lock and the roller 8 is lifted clear of the ramp 9. Safety circuit contactors (not shown in the figures) provided in the lock 12 are closed, whereupon the elevator is able to depart.

At the start of the door opening action, the locking is released by driving the door in the open direction by means of the door mechanism. As the coupling roller 2 is withdrawn, the spring force of the return spring 7 causes the lug 26 to follow the coupling roller 2 and, via the linkage 6, the roller 8 to be lowered back to the ramp 9 and the pin 10 of the lock 12 to be pulled up to permit the thrust plate 11 of the lock to move. The safety circuit contactors in the lock 12 are opened.

It is obvious to a person skilled in the art that the embodiments of the invention are not restricted to the examples described above, but that they may instead be varied in the scope of the claims presented below. For instance, the motion of the door can be transmitted to the linkage by using an element other than a roller, or the coupling roller can be connected in a different way in the door instead of to the door coupler vane. In addition, e.g. in a centre-opening door, both door panels can be provided with a thrust plate for the lock and the same lock pin can block the motion of both door panels. The thrust plate of the lock can be attached to another part of the door instead of to the suspension plate of the door. It is also obvious to the skilled person that the control of the driving motor of the door mechanism at the end of the closing movement of the door and at the beginning of the opening movement of the door can be implemented by specifically considering the properties and power requirement of the locking apparatus. It is further obvious to the skilled person that there are various mechanisms for moving automatic elevator doors and that each elevator can be provided with a mechanism that best suits it.

What is claimed:

1. Apparatus for locking a door of an elevator car movable in an elevator shaft, said shaft including a guide surface at each landing, said elevator car including a door actuating mechanism on the elevator car for moving the door along a door travelling path, said apparatus comprising:

a lock for locking the door of the elevator car;

a linkage for operating the lock in cooperation with said guide surface, said linkage including an operating lever having a roller thereon which, when at a landing, presses against the guide surface, the operating lever being pivotally attached to the linkage by a movable pivot; and a coupling element moved by the door actuating mechanism and fitted to transmit motion of the door produced by the door actuating mechanism to the linkage only at an ending portion of the door travelling path when the door is reaching a closed position.

2. The locking apparatus according to claim 1, wherein the coupling element is a roller that moves with horizontal movement of the door.

3. The locking apparatus according to claim 1, wherein the linkage is provided with a lug to which the coupling element is fitted to transmit the motion of the door produced by the door actuating mechanism to the linkage.

4. The locking apparatus according to claim 3, wherein the coupling element is a roller that moves with horizontal movement of the door.

5. The locking apparatus according to claim 3, wherein the coupling element is guided by a ramp including a downward sloping portion that slopes downwardly in the direction of the door closing movement, and wherein the ramp, the coupling element and the lug are so placed with respect to each other that, when the coupling element is on the downward sloping portion of the ramp, the coupling element is pressed against the lug.

6. The locking apparatus according to claim 1, wherein the lock and the linkage are mounted on an overhead supporting beam of the car door, and the lock includes a latch having a vertically movable pin so fitted that it will, by means of a thrust plate of the lock attached to the door, prevent the door from being opened when the pin is in an extended position, and permit the door to be opened when the pin is in a retracted position, wherein motion of the pin is controlled by a transmission bar connecting the linkage to the lock, the linkage being adapted to stop the lock closing movement of the transmission bar to effect a change of the position of the movable pivot of the operating lever so as to cause the roller of the operating lever to be disengaged from contact with the guide surface.

7. The locking apparatus according to claim 6, wherein the coupling element is a roller that moves with horizontal movement of the door.

8. The locking apparatus according to claim 6, wherein the linkage is provided with a lug to which the coupling element is fitted to transmit the motion of the door produced by the door actuating mechanism to the linkage.

9. The locking apparatus according to claim 8, wherein the coupling element is a roller that moves with horizontal movement of the door.

10. The locking apparatus according to claim 8, wherein the coupling element is guided by a ramp including a downward sloping portion that slopes downwardly in the direction of the door closing movement, and wherein the ramp, the coupling element and the lug are so placed with respect to each other that, when the coupling element is on the downward sloping portion of the ramp, the coupling element is pressed against the lug.

11. A method for locking and unlocking the car door of an elevator by means of a locking apparatus including a lock in the elevator car for locking the door, a guide surface in the elevator shaft at each landing, and a linkage acting on the lock, said linkage including an operating lever having a roller thereon which, when at a landing, presses against the guide surface, the operating lever being pivotally attached to the linkage by a movable pivot, said method comprising the steps of:

transmitting a driving power from a car door actuating mechanism to the linkage and further via the linkage to close the lock only when the door is reaching a closed position; and removing the force effect produced by the car door actuating mechanism from the linkage and permitting a return action that releases the lock to take place in the linkage in order to unlock the car door.

12. The method according to claim 11, further comprising the following steps for locking the car door with the lock:

coupling the driving power from the door actuating mechanism to the linkage at the final stage of the closing movement of the door;

using the driving power to shift the position of the pivot in the linkage; and producing the closing of the lock as a combined effect of the pivot being shifted and the operating lever pressing on the guide surface.

13. The method according to claim 12, further comprising the following steps for releasing the car door:

removing the force effect produced by the actuating mechanism from the linkage;

with the operating lever pressing on the guide surface, allowing the linkage to return to the condition that prevailed prior to the change produced by the driving power; and releasing the lock by this return action of the linkage.

14. The method according to claim 12, further comprising the following steps when locking the car door:

coupling the movement of the car door to the linkage; and causing the linkage to turn against the force generated by a return element provided in the linkage according to the movement of the car door.

15. The method according to claim 11, further comprising the following steps for releasing the car door:

removing the force effect produced by the actuating mechanism from the linkage;

with the operating lever pressing on the guide surface, allowing the linkage to return to the condition that prevailed prior to the change produced by the driving power; and releasing the lock by this return action of the linkage.

16. The method according to claim 15, further comprising the following steps when locking the car door:

coupling the movement of the car door to the linkage; and causing the linkage to turn against the force generated by a return element provided in the linkage according to the movement of the car door.

17. The method according to claim 15, further comprising the step of disengaging the roller on the operating lever from contact with the guide surface at the end of a car door locking operation.

18. The method according to claim 11, further comprising the following steps when locking the car door:

coupling the movement of the car door to the linkage; and causing the linkage to turn against the force generated by a return element provided in the linkage according to the movement of the car door.

19. The method according to claim 18, further comprising the step of disengaging the roller on the operating lever from contact with the guide surface at the end of a car door locking operation.

20. The method according to claim 11, further comprising the step of disengaging the roller on the operating lever from contact with the guide surface at the end of a car door locking operation.

* * * * *